US009003855B2

(12) United States Patent
Gracili et al.

(10) Patent No.: US 9,003,855 B2
(45) Date of Patent: Apr. 14, 2015

(54) PRESSURE RING FOR EXTRUSION PRESS AND EXTRUSION PRESS COMPRISING SUCH A PRESSURE RING

(75) Inventors: Luca Gracili, Milan (IT); Maurizio Cosolo, Magenta (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 302 days.

(21) Appl. No.: 13/261,232

(22) PCT Filed: Oct. 4, 2010

(86) PCT No.: PCT/EP2010/064708

§ 371 (c)(1), (2), (4) Date: Mar. 27, 2012

(87) PCT Pub. No.: WO2011/039373

PCT Pub. Date: Apr. 7, 2011

(65) Prior Publication Data

US 2012/0186319 A1 Jul. 26, 2012

(30) Foreign Application Priority Data

Oct. 2, 2009 (IT) ..... MI2009A1701

(51) Int. Cl.
*B21C 25/00* (2006.01)
*B21C 23/21* (2006.01)

(52) U.S. Cl.
CPC ..... *B21C 25/00* (2013.01); *B21C 23/212* (2013.01)

(58) Field of Classification Search
CPC .... B21C 23/21; B21C 23/212; B21C 23/215; B21C 23/005; B21C 23/001; B21C 25/00; B21C 25/02
USPC ..... 72/253.1, 263, 272, 273, 284
See application file for complete search history.

(56) References Cited

U.S. PATENT DOCUMENTS 3,369,385 A * 2/1968 Murphy et al. ..... 72/272

FOREIGN PATENT DOCUMENTS

| | | |
|---|---|---|
| DE | 1113197 | 8/1961 |
| GB | 1329133 | 9/1973 |
| JP | 57109519 A * | 7/1982 |

* cited by examiner

*Primary Examiner* — Debra Sullivan
(74) *Attorney, Agent, or Firm* — Stetina Brunda Garred & Brucker

(57) ABSTRACT

An extrusion press comprising a pressure ring (6) having a convex shape rear base (62) resting in a seat (71) of a platen (7). The convex shape is either spherical or truncated cone shaped so as to relieve onto the platen (7) the greatest amount of extrusion pressure exerted on the front face (61) of the pressure ring (6) of the die pack (3). This limits the deformation on the front base (61) and consequently the geometric variations of the extruded profile (5).

16 Claims, 6 Drawing Sheets

PRESSURE RING FOR EXTRUSION PRESS AND EXTRUSION PRESS COMPRISING SUCH A PRESSURE RING

FIELD OF THE INVENTION

The present invention refers to a pressure ring for extrusion press and extrusion press thereof.

STATE OF THE ART

In an extrusion press, the extrusion platen comprises a cylindrical, flat bottom seat with a concentric hole. The so-called pressure ring is accommodated in the seat.

This is a cylindrical element with a central hole, having two flat, reciprocally parallel faces.

The extrusion die is accommodated in the so-called die pack, which is in contact with the pressure ring, so that the extrudate passes freely through the hole in the pressure ring and the platen in which the pressure ring is accommodated.

By effect of the extrusion pressure, the die pack presses on the pressure ring, which relieves strain onto the platen.

The deformation of the system, and in particular of the contact surfaces between the pressure ring and the die pack, determines undesired variations of die geometry, and thus of the extrusion holes, which affect the final geometry of the extruded profile.

Finally, it is worth mentioning that the working force is not constant in an extrusion cycle: it typically decreases with the amount of residual material to be extruded. Consequently, the product obtained with the extrusion process is not geometrically uniform. Such a problem is even more apparent on thin extruded profiles when considered in percentage terms. In conclusion, the deformation of the pressure ring of an extrusion press determines variations of the extruded profile geometry which, above all for thin profiles, negatively affects final product quality.

In order to limit this drawback, the prior art teaches to increase the thickness of the platen to increase the total flexural rigidity of the system, thus seeking a reasonable cost/benefit ratio.

Patent GB904275 is known which describes an extrusion press contemplating the use of a pressure ring made of two spherical parts for allowing to adjust the orientation of the die pack, thus forming a spherical coupling, the concave and convex surfaces of which have the same radius and mate perfectly. When the press is unladen or under low load, there is no gap between the two surfaces and the elastic deformations of the structure when subjected to high loads cannot be compensated and therefore the deformation of the surface on which the dies rests cannot be contained.

SUMMARY OF THE INVENTION

It is the object of the present invention to provide a pressure ring for extrusion press, and extrusion press thereof, adapted to solve the aforesaid problems without needing to resort to excessively increasing the thickness of the platen.

It is the object of the present invention a pressure ring for an extrusion press having a platen which according to claim 1 comprises a front base and a rear base, said rear base being adapted to rest on a resting surface of the platen, characterized in that said rear base has either a convex surface with a wide curvature radius or a flat surface, and in that in unladen conditions the resting surface of the platen is adapted to touch the rear base only by a limited part of its total surface.

Said convexity is defined according to the geometric features of the extrusion press, of the flexural rigidity of the platen, and/or of the extrusion force and/or of the contact pressure on the pressure ring and/or of the distribution of said pressures on the front surface.

More specifically, said convexity is such that when applying the maximum extrusion force the planarity of the front base of the pressure ring, which is in contact with the die pack of the extrusion press, is ensured.

In general, various interchangeable pressure rings can be prepared, each of which with an appropriately shaped rear base for machining within a specific range of extrusion force values, so as to be able to always guarantee the maximum geometric variation for all types of extruded profiles.

According to embodiments, said rear base may be a truncated cone or a truncated sphere or a combination thereof.

Advantageously, the geometry of the rear base of the pressure ring is shaped so that the contact with the platen seat is complete only for force values close to the maximum working load for which the pressure ring is designed. In this manner, the deformation is prevalently located on the platen, thus limiting the deformations of the pressure ring, which thus preserves a nearly flat geometry on the front base in contact with the die pack.

According to another aspect of the present invention, it is the further object of the present invention an extrusion press comprising a platen and at least one pressure ring, wherein the platen has a seat of the pressure ring with a substantially flat resting surface, and wherein at least one pressure ring has a convex shape rear base resting on the resting surface of the platen.

It is the specific object of the present invention a pressure ring for extrusion press, and extrusion press thereof, as described in greater detail in the claims, which form an integral part of the present description.

BRIEF DESCRIPTION OF THE FIGURES

Further features and advantages of the present invention will be apparent in the light of the detailed description of preferred, but not exclusive, embodiments of a pressure ring for extrusion press illustrated by way of non-limitative examples, with the aid of the appended drawings, wherein.

The same reference numbers and letters in the figures refer to the same elements or components.

DETAILED DESCRIPTION OF PREFERRED EMBODIMENTS OF THE INVENTION

Figure 1:
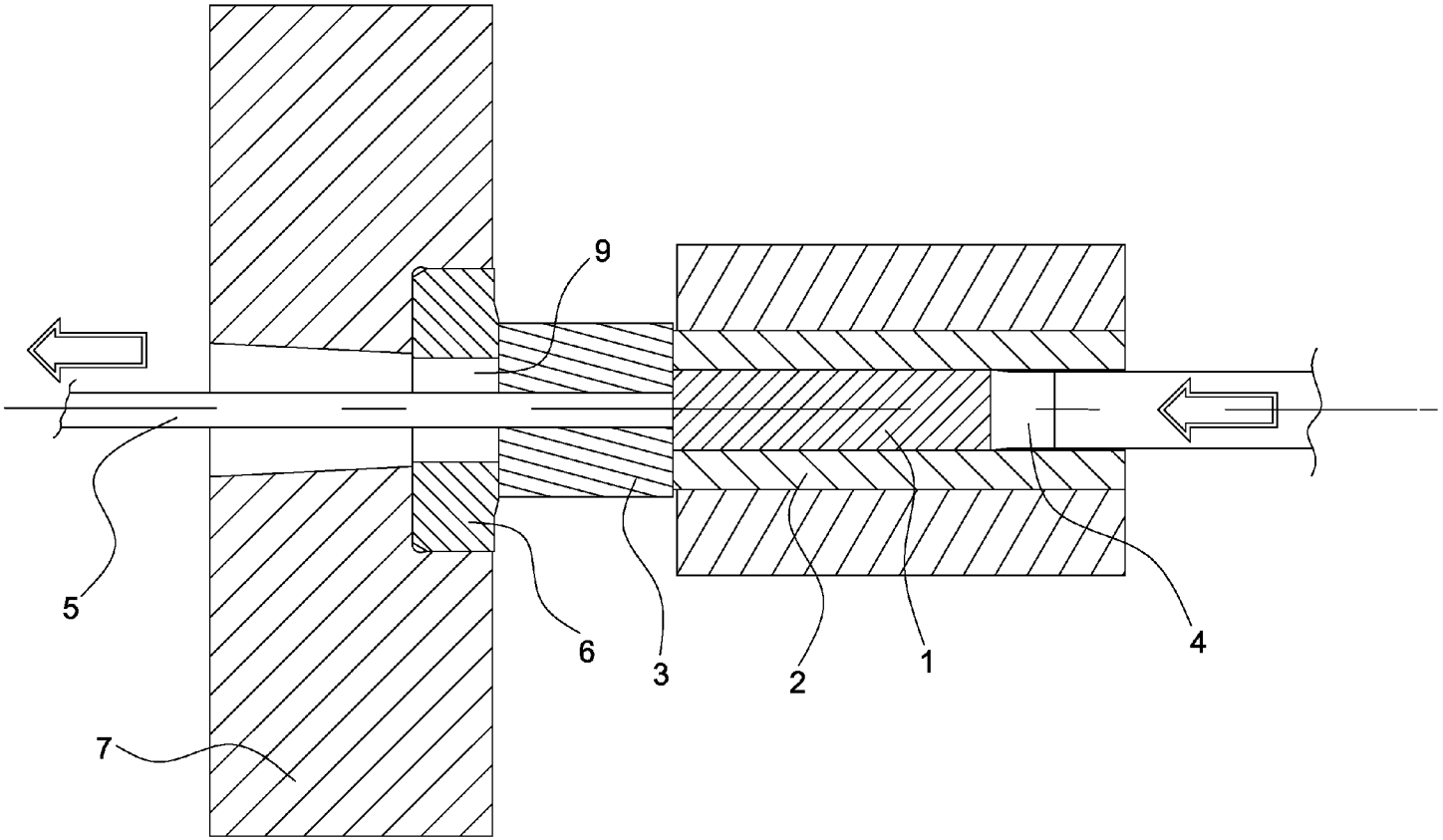
FIG. 1 is a section of a portion of the extrusion press comprising a pressure ring in accordance with the invention.

An extrusion system according to the present invention contemplates a so-called billet to be extruded 1 which is within a container 2, which is in contact with a die pack 3. The extrusion pressure exerted by means of a dummy block 4, causes the material or billet to flow through the die pack 3, with the consequent formation of an extruded profile 5 downstream of the die pack itself.

The die pack 3, during operation, under action of the extrusion force developed by the press, presses against a pressure ring 6 accommodated in a specific seat 70 of the platen 7. In this example, the seat is obtained in a cavity of the platen. The cavity may have cylindrical section, according to the shape of the section of the pressure ring. In particular, the front base 61 of the pressure ring 6 is in contact with the die pack 3, while the rear base 62 is in contact with the platen 7, and in particular with the abutment surface 71 of the seat 70.

Figure 5:
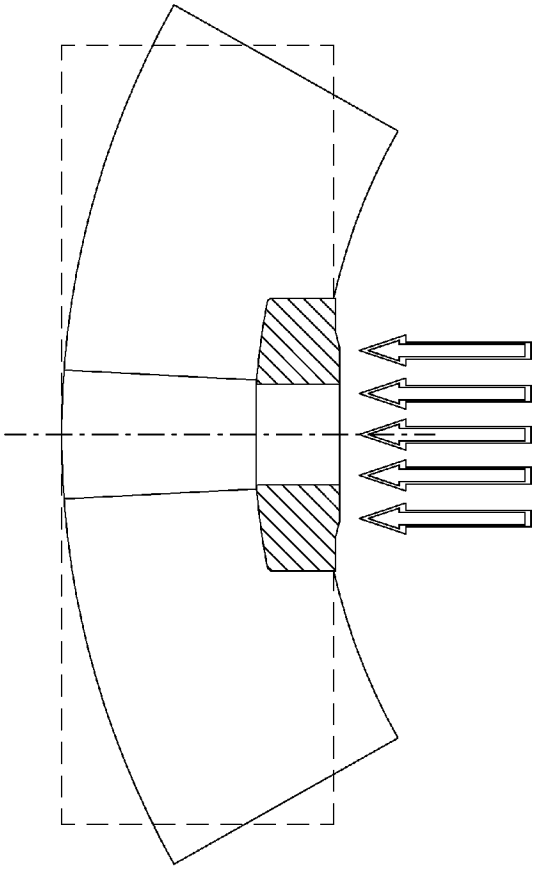
FIG. 4 and FIG. 5 show increasing shape variations, emphasized for better understanding, that detail FIG. 2 undergoes as the extrusion force increases.
Figure 4:
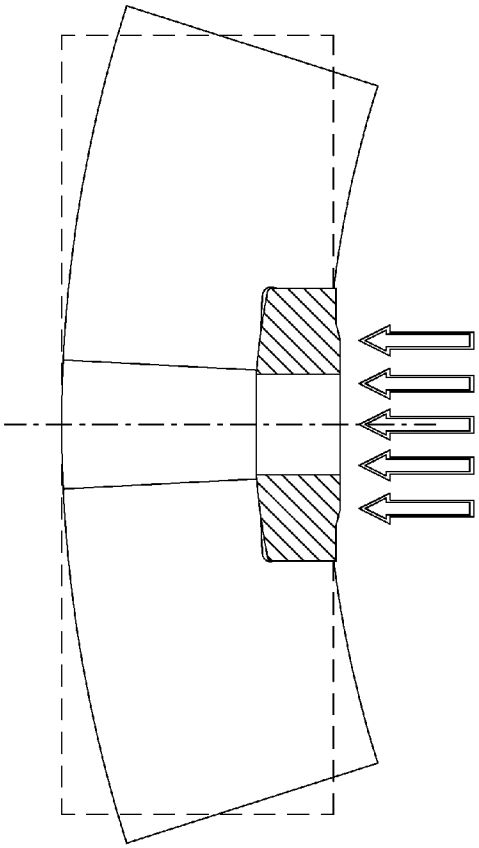

Thus, in accordance with the present invention, the geometry of the rear base 62 of the pressure ring 6 is made so that the deformation of the front base 61 is highly reduced in extrusion conditions because the platen is induced to compensate for nearly all the deformations, as clearly shown in the diagrams in FIGS. 4 and 5.

Figure 2:
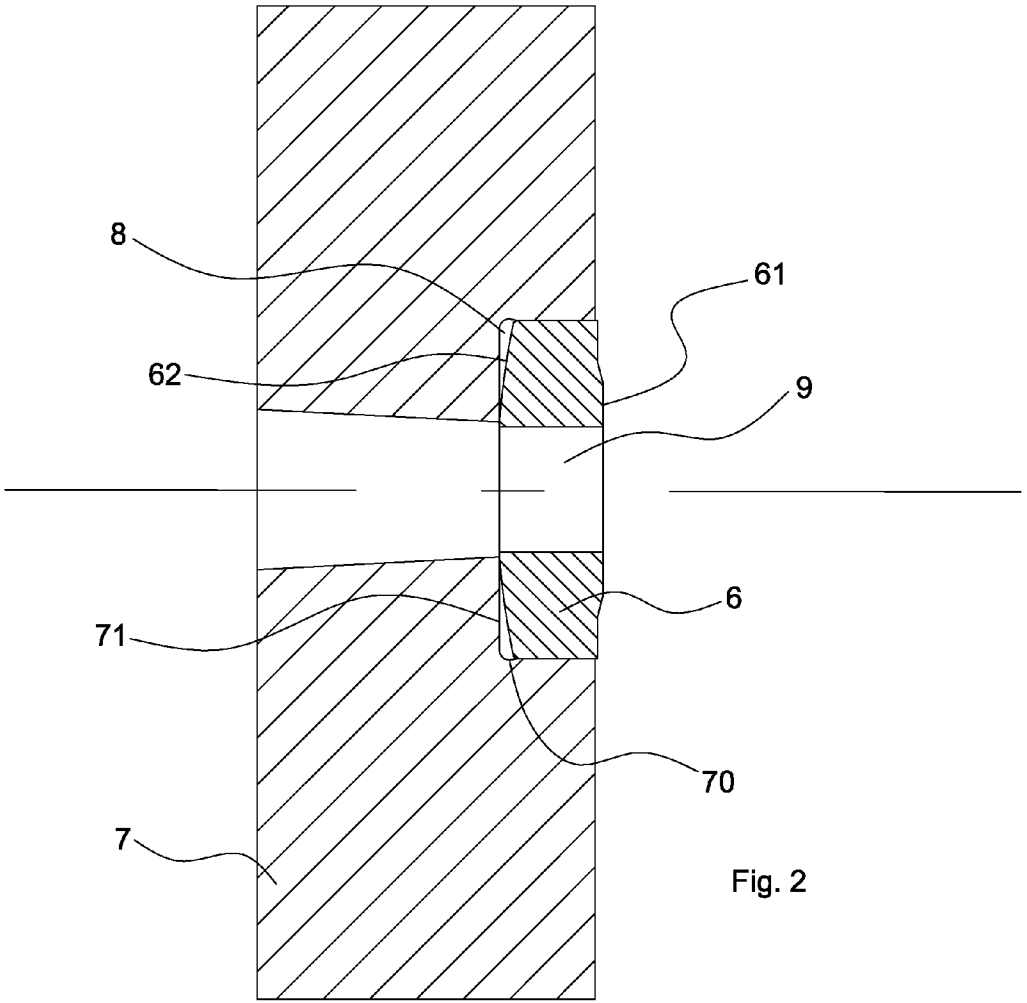
FIG. 2 is a detail of the previous figure.
Figure 3:
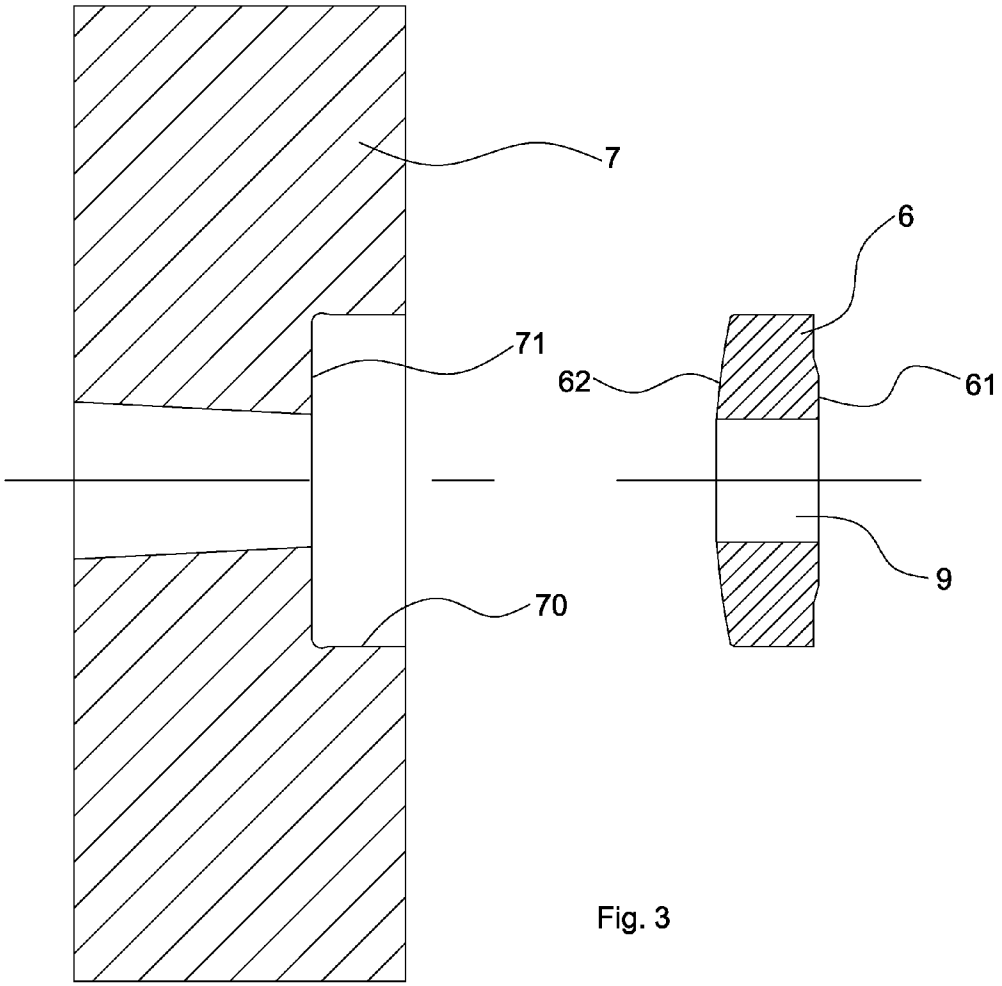
FIG. 3 is an exploded view of the detail in FIG. 2.

In particular, the rear base 62 of the pressure ring is shaped so that, with the press unladen or for low extrusion force values, the contact with the seat 70 of the platen 7 is located in proximity of the extrusion hole 9. Such a circumstance is shown in FIG. 2, in which an initial gap 8 comprised between the surface of the rear base 62 and the surface 71 is visible. Such a result is obtained by making surface 71 of the seat 70 of the platen 7 either flat or having a very large radius curvature shape such as to approach an infinite length such as that of a flat surface. However, large radius spherical surfaces, or truncated-cone shaped surfaces with wide vertex angles, i.e. close to 180°, or the like can be chosen. The surface of the rear base 62 of the pressure ring may be spherical, elliptical or the like with curvature radius much smaller than that of the surface 71 of the seat 70. The surface of the rear base 62 may also be truncated cone shaped with a smaller vertex angle than that of the surface 71 of the seat 70.

In the most demanding working conditions, the contact area between the pressure ring and the platen 7 is progressively higher as the extrusion force increases. FIGS. 4 and 5 show the deformations undergone by the platen as the extrusion force increases. In particular, in FIG. 5, it is apparent that said gap 8 has completely disappeared as a result of the perfect adhesion between rear base 62 of the extrusion block and the seat 70 of the platen 7. On the contrary, in FIG. 2, the platen is unladen, the contact points between the rear base 62 and the seat 70 are limited to an area surrounding the central hole 9.

Various embodiment variations of the described non-limiting example are possible, without departing from the scope of protection of the present invention.

Figure 6:
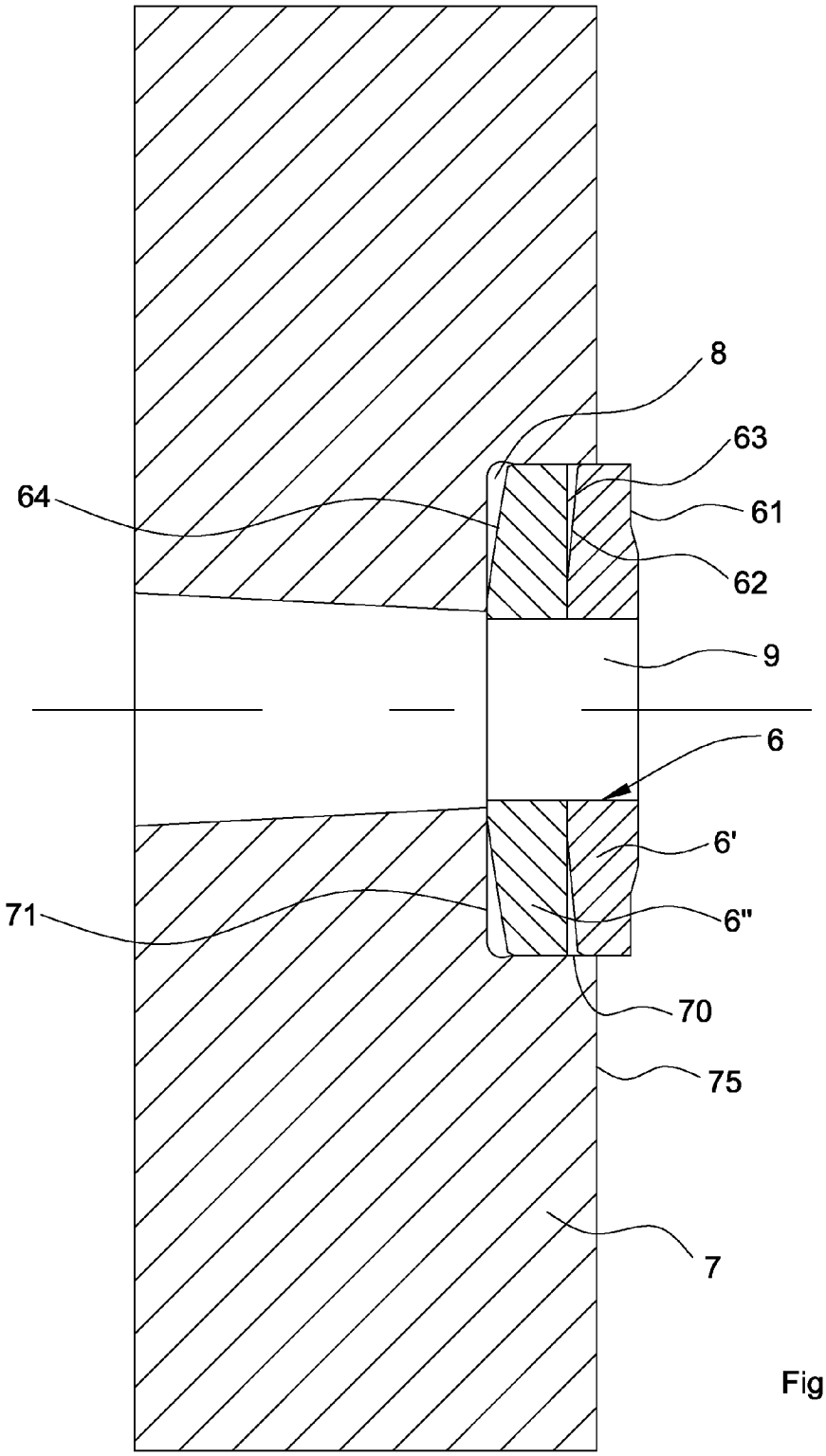
FIG. 6 is a first variant embodiment of the pressure ring.
Figure 7:
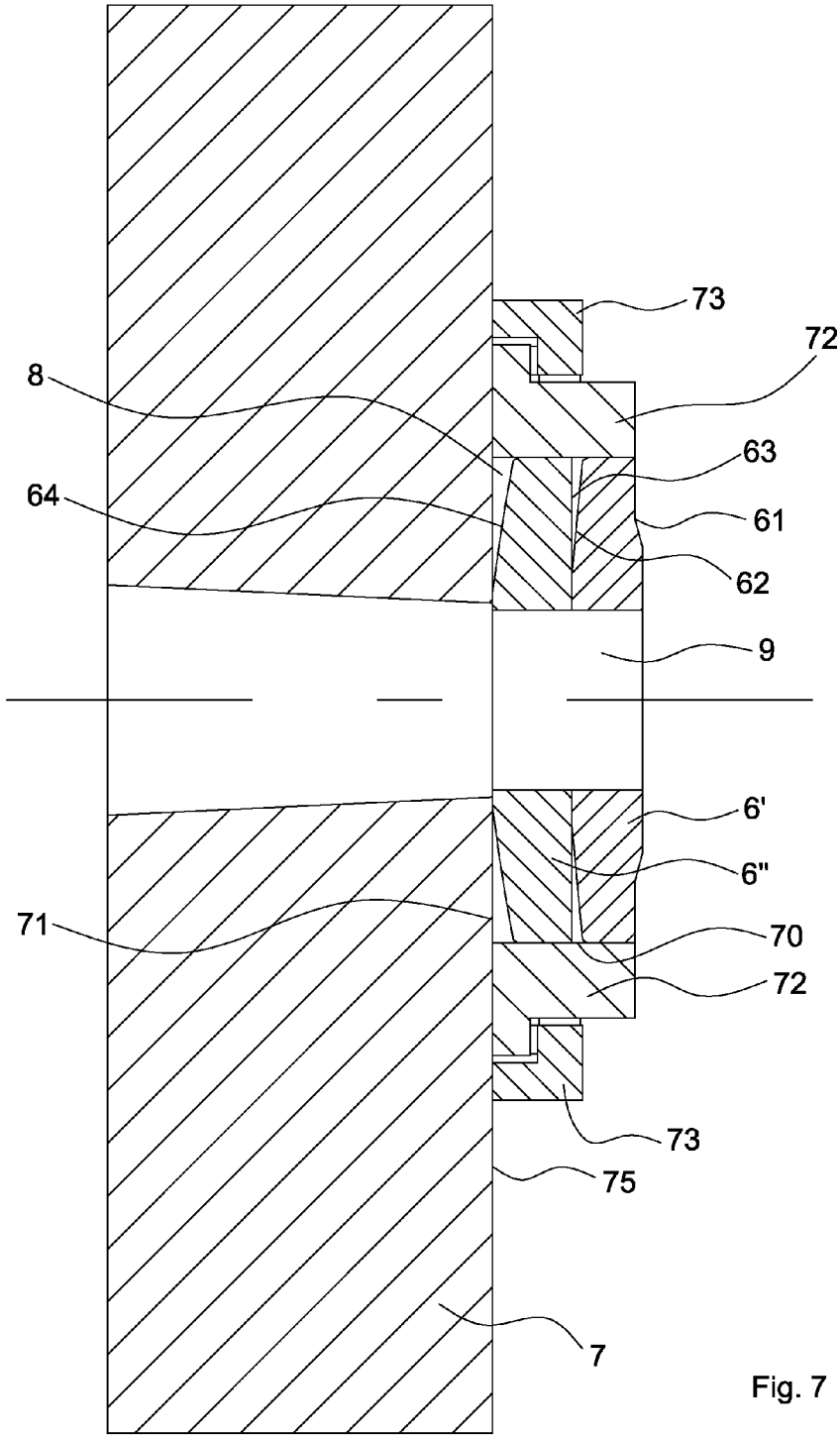
FIG. 7 is a second variant embodiment of the pressure ring.

For example, by exploiting the principle illustrated above of shaping the contact surfaces by inserting appropriate initial gaps, in particular reference to FIGS. 6 and 7, a pressure ring 6 made in two or more parts 6', 6" sandwiched in sequence, may be contemplated in the various combinations which can be obtained to vary the geometries of the respective mutually associated, either flat or convex bases 61, 62, 63, 64, in order to better distribute deformations and forces and/or to minimize the deformations of the front face of the pressure ring 6 in presence of high variations of the extrusion force and/or of the distribution of pressures on the front face of the pressure ring.

Another variant shown in FIG. 6 contemplates only partially accommodating the pressure ring 6, formed by either one or several parts, in the recess constituting the seat 70: in this case, the depth of the recess in the platen is shallower than the thickness of the pressure ring 6, which protrudes in part from the edge 75 of the platen 7.

Alternatively, the pressure ring (formed by one or several parts) may be mounted resting on the platen 7 at the surface 71, which is a zone of the surface 75 of the platen 7 entirely free from recesses.

This alternative embodiment is shown in FIG. 7, in which the pressure ring 6, either made of one part, as shown in figures from 1 to 5, or of several parts, as in the variants in FIGS. 6 and 7, may be fixed to the platen by means of an overhangingly arranged, removable element 72, 73 and which forms the seat 70. This embodiment allows to move the pressure ring for replacement or maintenance.

In a further advantageous variant, which may be applied to all embodiments in figures from 1 to 7, but not illustrated, the convex shaped may be that of the surface 71 of the seat 70 of the platen either arranged within the cavity of coplanar with the surface 75, while the rear base 62 or 64 of the pressure ring 6 has a flat surface in this case.

In all the variants described above, the convexity is such to compensate for the deformations which are produced on the platen by effect of the extrusion pressure, and is such to limit the shape variations of the interface surface on the front base 61 with the die pack.

Therefore, the platen 7, by deforming/bending by an amount with depends on the extrusion force, increasingly adheres against the seat 70 of the rear base 62 of the pressure ring 6.

Briefly, the main benefits deriving from the application of the invention are:

- considerable reduction of the deformations of the front base 61 of the pressure ring;
- considerable reduction of geometric variations on the extrusion profile with a higher level of the final product;
- reduction of the thickness and of the costs of the platen 7;
- reduction of the width, and consequently of the costs, of the columns withholding the platen.

The elements and features illustrated in the various embodiments may be combined without because of this departing from the scope of protection of the invention. From the description above, a person skilled in the art will be able to implement the object of the invention without introducing further constructional details.

The invention claimed is:

1. Assembly of a platen and at least one pressure ring for an extrusion press, the platen comprising a resting surface, the at least one pressure ring comprising a front base contactable by a die pack of said extrusion press and a rear base, the rear base resting on said resting surface, characterized in that either the rear base has a convex surface and the resting surface has a flat surface or the rear base has a flat surface and the resting surface has a convex surface, and in that, in unladen conditions, the resting surface touches the rear base only by a limited part of its total surface, thus providing a gap between the surface of the rear base and the surface of the platen.

2. An assembly according to claim 1, wherein said convex surface is a truncated cone or a truncated sphere or a combination thereof.

3. An extrusion press comprising a platen, at least one pressure ring and a die pack, wherein the platen has a seat accommodating the at least one pressure ring comprising a substantially flat resting surface, characterized in that the at least one pressure ring has a convex shape rear base resting on the resting surface of the platen, said at least one pressure ring comprising a front base which is in contact with said die pack.

4. An extrusion press according to claim 3, wherein the convex shape of the rear base consists of a truncated cone or a truncated sphere or a combination thereof.

5. An extrusion press according to claim 3, wherein the resting surface is contained in a cavity of the platen constituting the seat accommodating the at least one pressure ring and wherein said seat has a depth such as to totally or partially accommodate the at least one pressure ring.

6. An extrusion press according to claim 3, wherein said seat of the at least one pressure ring comprises a removable element overhangingly resting on the platen about the resting surface.

7. An extrusion press according to claim 3, wherein said pressure ring is made of two or more parts arranged in sequence, each of which is provided with a respective, mutually associated front base and rear base.

8. An extrusion press according to claim 7, wherein the respective rear bases of said parts of said pressure ring have reciprocally different convexities determined according to different working conditions of the press.

9. An extrusion press according to claim 8, wherein one or more of said parts of said pressure ring have a respective front convex shaped base.

10. An extrusion press comprising a platen, at least one pressure ring and a die pack, wherein the platen has a seat accommodating the at least one pressure ring comprising a convex resting surface, and wherein the at least one pressure ring has a substantially flat rear base resting on the resting surface of the platen, said at least one pressure ring comprising a front base which is in contact with said die pack.

11. An extrusion press according to claim 10, wherein the convex shape of the resting surface consists of a truncated cone or a truncated sphere or a combination thereof.

12. An extrusion press according to claim 10, wherein the resting surface is contained in a cavity of the platen constituting said seat of said at least one pressure ring and wherein said seat has a depth such as to totally or partially accommodate said at least one pressure ring.

13. An extrusion press according to claim 10, wherein said seat of said at least one pressure ring comprises a removable element overhangingly resting on the platen about the resting surface.

14. An extrusion press according to claim 10, wherein said pressure ring is made of two or more parts arranged in sequence, each of which is provided with a respective, mutually associated front base and rear base.

15. An extrusion press according to claim 14, wherein the respective rear bases of said parts of said pressure ring have reciprocally different convexities determined according to different working conditions of the press.

16. An extrusion press according to claim 15, wherein one or more of said parts have a respective front convex shaped base.

* * * * *